US005170916A

United States Patent [19]

Kolton et al.

[11] Patent Number: 5,170,916

[45] Date of Patent: Dec. 15, 1992

[54] ANTI-SLIP GARMENT HANGER

[75] Inventors: Chester Kolton, Westfield; Stuart S. Spater, Livingston, both of N.J.

[73] Assignee: A & E Products Group, a division of Carlisle Plastics, Inc., Woodbridge, N.J.

[21] Appl. No.: 722,457

[22] Filed: Jun. 27, 1991

[51] Int. Cl.[5] ..... A47G 25/30

[52] U.S. Cl. ..... 223/92; 223/85

[58] Field of Search ..... 223/92, 95, 88, 85; D6/315, 318; 211/113

[56] References Cited

U.S. PATENT DOCUMENTS

| | | | |
|---|---|---|---|
| D. 299,889 | 2/1989 | Spitz | D6/318 |
| 1,320,445 | 11/1919 | Butrick . | |
| 1,321,997 | 11/1919 | Duberstein | 223/92 |
| 1,886,126 | 11/1932 | Sessions | 223/88 |
| 2,132,895 | 10/1938 | Fewster | 223/92 |
| 2,376,269 | 5/1945 | Pauli | 223/88 |
| 2,622,274 | 12/1952 | Oldham | 211/89 |
| 2,835,422 | 5/1958 | Stuard | 223/92 |
| 2,912,149 | 11/1959 | Stuard | 223/92 |
| 3,168,970 | 2/1965 | Wilson | 223/92 |
| 3,358,891 | 12/1967 | Rowe | 223/88 |
| 4,368,823 | 1/1983 | Beckwith | 223/85 |
| 4,586,637 | 5/1986 | Lemel | 223/92 |

FOREIGN PATENT DOCUMENTS

| | | | |
|---|---|---|---|
| 114130 | 6/1941 | Australia | 223/88 |
| 1252836 | 10/1967 | Fed. Rep. of Germany | 223/85 |
| 1258892 | 3/1961 | France | 223/88 |

*Primary Examiner*—Werner H. Schroeder
*Assistant Examiner*—Bibhu Mohanty
*Attorney, Agent, or Firm*—Blum Kaplan

[57] ABSTRACT

A garment hanger including a body having a neck with a hook and a pair of shoulders having a plurality of apertures. An anti-slip insert including a plurality of raised portions corresponding to the number of apertures in the shoulders is inserted onto the garment hanger through the apertures. The construction prevents garments from slipping off of the hanger.

10 Claims, 2 Drawing Sheets 10
12
14
16
18
20
22
24
26
32
34
100
3

ANTI-SLIP GARMENT HANGER

BACKGROUND OF THE INVENTION

This invention is directed generally to an anti-slip garment hanger and, in particular, to a plastic garment hanger with anti-slip inserts on the shoulders of the hanger that prevent a garment, especially garments such as sweaters or the like, from slipping off of the hanger.

While garment hangers have taken many forms over the years, anti-slip garment hangers are known in the art as exemplified, for example, by U.S. Pat. No. 1,321,997, issued on Nov. 18, 1919. U.S. Pat. No. 1,321,997 is directed to a garment hanger having cut-away sections or recessed areas in the shoulder portions of the hanger in which inserts with upwardly extending teeth are provided. The teeth extend slightly above the upper surface of the hanger to hold thin and flimsy garments on the hanger.

Such prior art garment hangers have several drawbacks. First, the inserts must be properly affixed to the hanger and therefore must be properly sized and formed to fit in the recessed areas. In addition, excess material is required to form the inserts, manufacturing costs are increased and manufacture may prove difficult.

Accordingly, it is desired to provide a garment hanger with inserts that feature an anti-slip surface which overcomes the disadvantages of the prior art discussed above.

SUMMARY OF THE INVENTION

Generally speaking, in accordance with the present invention, an anti-slip garment hanger including a body is provided. The body of the hanger includes a neck portion, a hook coupled to the neck for hanging the hanger and a pair of shoulders extending outwardly from the neck portion. Each of the shoulders includes a plurality of openings respectively therethrough. An insert for each shoulder includes a base having a plurality of raised portions corresponding to each of the openings in the shoulders. The raised portions extend through the apertures in the shoulders from below.

In a preferred embodiment, a pair of sloped projection members extend laterally from the sides of each raised portion of the insert facilitating insertion while at the same time securing the insert in the hanger.

Accordingly, it is desired to provide an improved anti-slip garment hanger.

A further object of the present invention to provide a garment hanger with openings therein which cooperate with an insert to prevent garments from slipping off the hanger.

Another object of the present invention is to provide a garment hanger having an anti-slip insert which is securely fastened to the hanger yet easy to install.

Still another object of the present invention is to provide an anti-slip insert for a garment hanger which prevents garments from slipping while cooperating with openings in the shoulders of the hanger to permit easy insertion and removal while being securely retained in the hanger.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENT

Figures 1, 2:
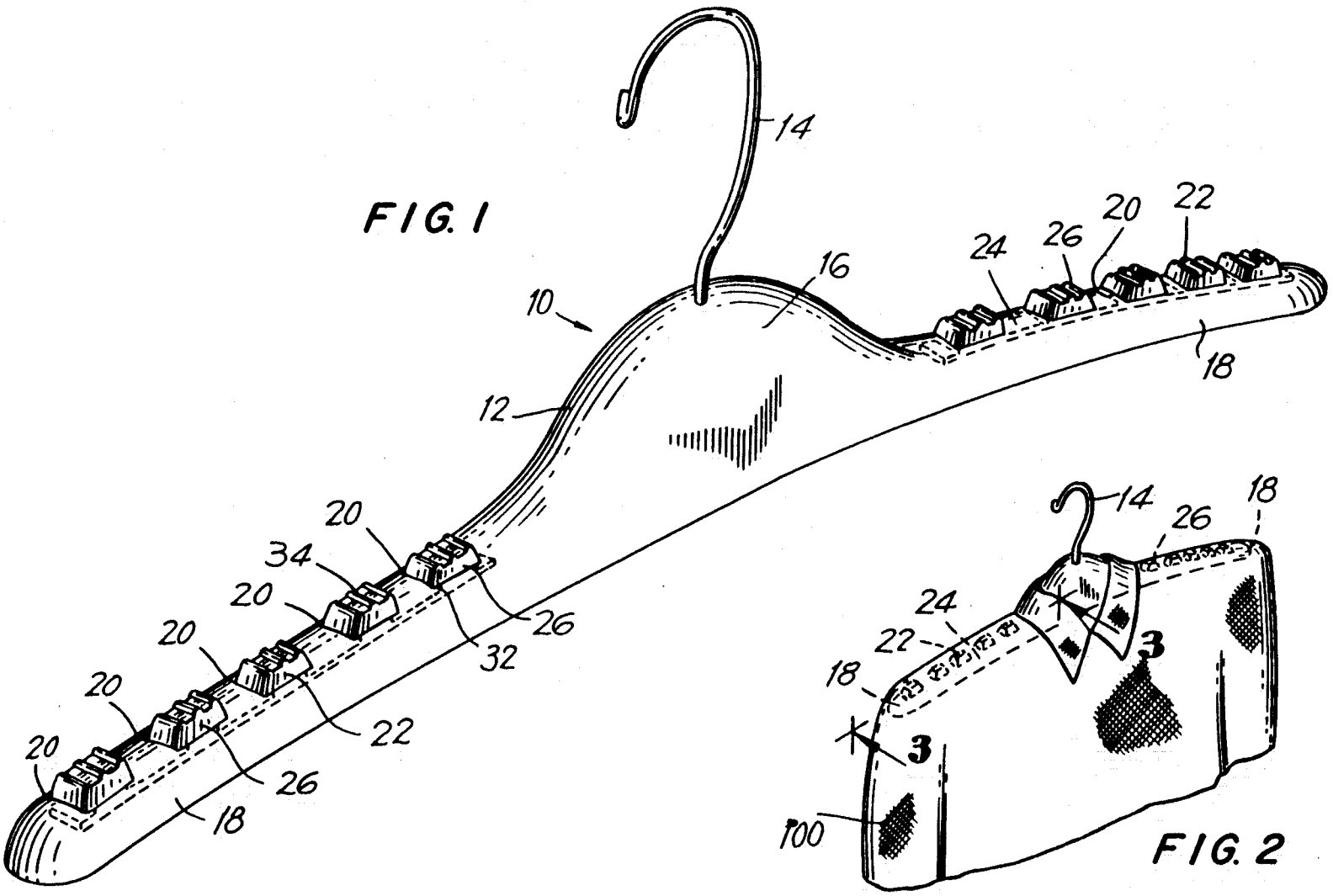
FIG. 1 is a perspective view of an anti-slip garment hanger constructed in accordance with a preferred embodiment of the present invention.
FIG. 2 is a perspective view of the garment hanger depicted in FIG. 1 shown with a garment hung thereon.

The drawings generally depict a garment hanger with a pair of anti-slip inserts, specifically anti-slip inserts which are respectively coupled to each shoulder of the hanger from its underside through openings spaced along each shoulder.

In a preferred embodiment of the present invention, each anti-slip insert includes a base and a predetermined number of raised portions corresponding respectively to the number of openings in the shoulders of the hanger. Each raised portion includes a pair of projections sloping outwardly from opposing sides of each raised portion. The top surface of each raised portion includes ribs. This construction prevents garments from slipping off the hanger while also creating a relatively tight locking fit which prevents accidental dislodgement of the inserts.

Reference is made to FIGS. 1 through 4 of the drawings wherein a garment hanger, generally indicated at 10, and constructed in accordance with a preferred embodiment of the present invention, is depicted. Hanger 10 is preferably molded from a plastic material including thermoplastic and thermosetting resins and other polymer materials. Hanger 10 includes a body 12 having a neck 16 and a pair of shoulders 18 extending outwardly from opposite sides of neck 16. Neck 16 includes a hook 14 extending upwardly therefrom for supporting the hanger from a rod or other support. Each of shoulders 18 includes a plurality of openings 20 spaced thereacross. As described below in detail, openings 20 are provided to support an insert 22 provided on each of shoulders 18.

Insert 22 is preferably formed from a flexible, rubber-like material. Insert 22 includes a base portion 24 having a generally rectangular shape and a plurality of rectangular raised portions 26 extending upwardly from base 24. The number of raised portions 26 on each insert corresponds to the number of openings 20 on each shoulder 18. Each raised portion 26 has a top surface 34 having several ribs extending laterally thereacross. Each of raised portions 26 is also provided with a pair of opposing outwardly sloping projection members 28 and 30 on the sidewalls thereof. Projection members 28 and 30 preferably project from somewhat below ribbed top surface 34 of each of raised regions 26.

Figure 3:
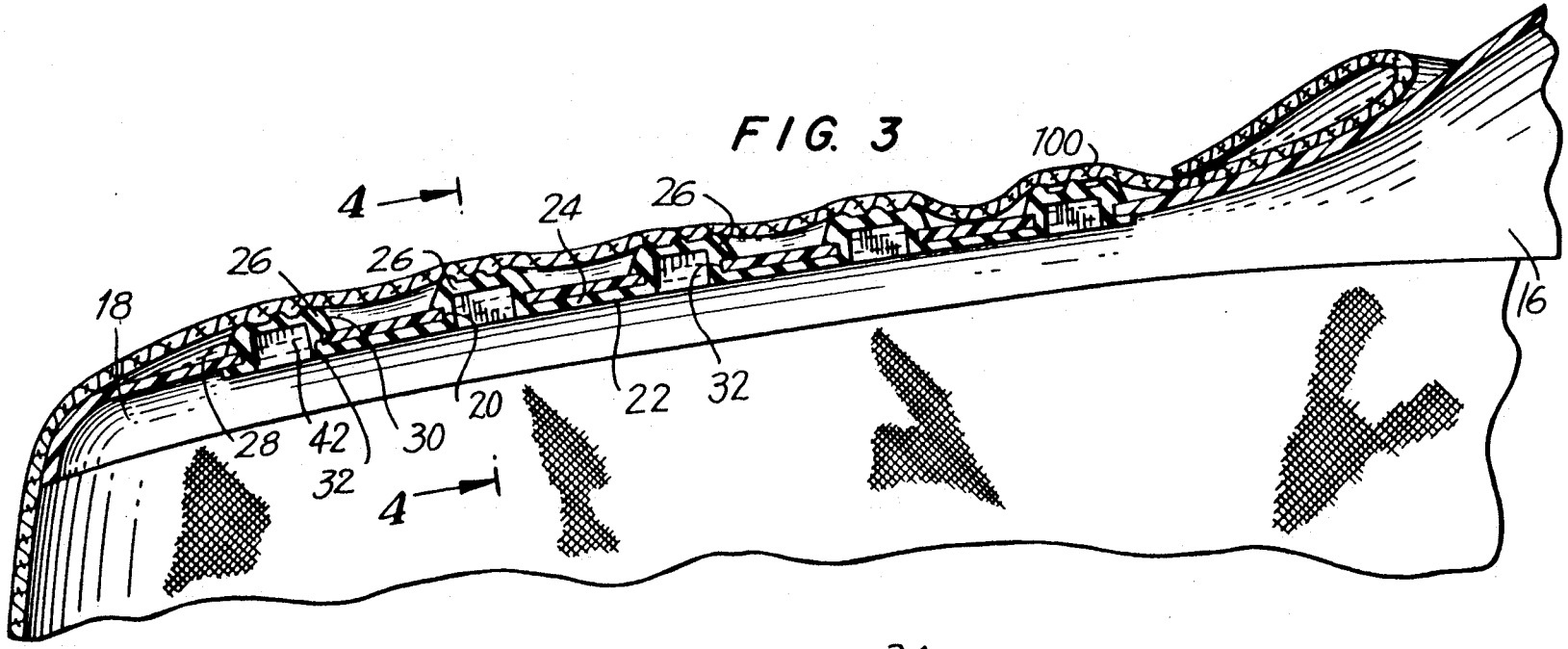
FIG. 3 is an enlarged sectional view taken along line 3—3 of FIG. 2; and, FIG. 4 is an enlarged sectional view taken along line 4—4 of FIG. 3.
Figure 4:
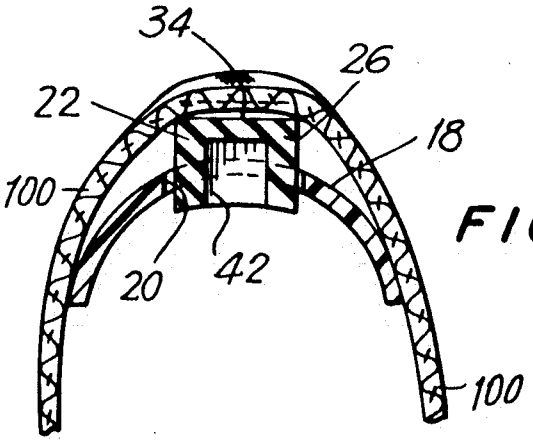

Insert 22 is inserted in garment hanger 10 from underneath shoulder 18 during manufacture. Raised portions 26 extend through corresponding openings 20 and extend above the top surface of shoulder 18. Raised portions 26 can easily pass through apertures 20 because a center section 42 of each raised portion 26 is hollow as best depicted in FIGS. 3 and 4. As raised portion 26 passes through aperture 22, projection members 28 and 30 are forced inward upon making contact with an edge 32 of aperture 20.

Once projection members 28 and 30 pass beyond aperture edge 32, they resume their initial position and rest on shoulder 18 preventing inadvertent removal of insert 22.

Once inserts 22 are in place, hanger 10 can be used to display many types of garments without slippage. Inserts 22 have a higher coefficient of static friction than most garments and therefore, when a garment 100 comes in contact with insert 22, there is less likelihood that garment 100 will slip off hanger 10. In addition, top ribbed portion 34 creates a surface favorable for preventing slippage.

Furthermore, garments with thin shoulder straps can be secured to hanger 10 by placing the shoulder straps between raised portions 26.

Finally, due to projection members 28 and 30 locking on the surface of shoulder 18, insert 22 is securely coupled to shoulder 18.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A garment hanger for supporting a garment by the shoulders thereof, comprising a body, said body including a neck portion and a pair of shoulders extending outwardly from opposing sides of said neck portion, a hook coupled to said body, each said shoulder including a plurality of openings therein, and an insert for each shoulder, each said insert including a base portion, said base portion having a plurality of deformable raised portions extending upwardly therefrom and presenting an exposed upper frictional surface to substantially prevent said garment when supported on the shoulders of said body from slipping off, each one of said raised portions extending through and being supported by a respective opening on said respective shoulder and extending beyond the upper surface of said shoulders, and coupling means on each said raised portion for securing said raised portions in said openings, each said upper surface of each of said raised portion including exposed ribs which contact said garment when resting on said body.

2. The garment hanger as claimed in claim 1, wherein each said raised portion is hollow.

3. The garment hanger as claimed in claim 1, wherein each said insert is formed from a flexible rubber-like material.

4. The garment hanger as claimed in claim 1, wherein said neck portion is integrally formed with said shoulders.

5. A garment hanger for supporting a garment by the shoulders thereof, comprising a body, said body including a neck portion and a pair of shoulders extending outwardly from opposing sides of said neck portion, a hook coupled to said body, each said shoulder including a plurality of openings therein, and an insert for each shoulder, each said insert including a base portion, said base portion having a plurality of deformable raised portions extending upwardly therefrom and presenting an exposed upper frictional surface to substantially prevent said garment when supported on the shoulders of said body from slipping off, each one of said raised portions extending through and being supported by a respective opening on said respective shoulder and extending beyond the upper surface of said shoulders, and coupling means on each said raised portion for securing said raised portions in said openings, said coupling means including raised projections on opposing sides of said raised portions.

6. A garment hanger comprising a body having upper and lower surfaces, said body including a neck portion and a pair of shoulders extending outwardly from opposing sides of said neck portion, said body including a hook coupled thereto, each said shoulder including at least one opening extending through said upper and lower surfaces, and an insert extending respectively through said at least one opening, said insert including a base, a flexible raised portion presenting an upper exposed frictional surface to substantially prevent a garment supported on said surface from slipping off of said body, said flexible raised portion extending upwardly from said base, and locking means projecting laterally from opposing sides of said flexible raised portion to secure said insert in said at least one opening to prevent movement of said insert during use.

7. The garment hanger as claimed in claim 6, wherein said raised portion of said insert extends above the top surface of said shoulder.

8. The garment hanger as claimed in claim 6, wherein the upper surface of said raised portion includes ribs.

9. The garment hanger claimed in claim 6, wherein at least a portion of said raised portion is hollow.

10. The garment hanger as claimed in claim 6, wherein said insert is formed from a rubber-like material.

* * * * *